US005197497A

United States Patent [19]

Gueret

[11] Patent Number: 5,197,497

[45] Date of Patent: Mar. 30, 1993

[54] PROCESS FOR MANUFACTURE OF A COSMETIC BRUSH

[75] Inventor: Jean-Louis H. Gueret, Paris, France

[73] Assignee: L'Oreal, Paris, France

[21] Appl. No.: 753,999

[22] Filed: Sep. 3, 1991

[30] Foreign Application Priority Data

Nov. 13, 1990 [FR] France ..... 90 14033

[51] Int. Cl.[5] ..... A45D 40/26

[52] U.S. Cl. ..... 132/218; 132/216; 132/320

[58] Field of Search ..... 132/216, 218, 317, 320

[56] References Cited

U.S. PATENT DOCUMENTS

| | | | |
|---|---|---|---|
| 4,461,312 | 7/1984 | Gueret | 132/218 |
| 4,586,520 | 5/1986 | Brittain | 132/218 |
| 4,733,425 | 3/1988 | Hartel et al. | 132/218 |
| 4,861,179 | 8/1989 | Schrepf et al. | 132/218 |
| 4,961,665 | 10/1990 | Fitjer | 132/218 |
| 4,964,429 | 10/1990 | Cole | 132/218 |

FOREIGN PATENT DOCUMENTS

| | | |
|---|---|---|
| 0239270 | 9/1987 | European Pat. Off. . |
| 2637472 | 4/1990 | France . |

*Primary Examiner*—Gene Mancene
*Assistant Examiner*—Frank A. LaViola
*Attorney, Agent, or Firm*—Cushman, Darby & Cushman

[57] ABSTRACT

The brush (1) comprises a plurality of bristles (4, 5) transversely implanted in a core (2), in particular, formed by twisted metal spirals, at least part of the bristles being formed by a mixture of bristles of relatively large transverse section (4) and bristles of relatively small transverse section (5). In at least one zone of the brush, the bristles of relatively large section (4) are longer than the bristles of small section (5) and at least the outer ends of the bristles of small section (5) display a bulge (6).

12 Claims, 2 Drawing Sheets

PROCESS FOR MANUFACTURE OF A COSMETIC BRUSH

BACKGROUND OF THE INVENTION

The invention relates to a brush for the application of a cosmetic product of the type comprising a plurality of bristles transversely implanted in a core, in particular, formed by twisted metal spirals, at least part of the bristles being formed by a statistical mixture of bristles of relatively large transverse section and bristles of relatively small transverse section.

A brush of this kind is more particularly adapted to the application of mascara to the eyelashes, but may also be used for hair treatment, e.g. dyeing.

Brushes of this kind are generally used to take up a make-up product or the like from a container provided with a wiper lip traversed by the brush as it is extracted. When the brush is provided with bristles of relatively small section, only a small quantity of the product remains on the bristles following wiping and the resulting make-up is weak. Moreover, when the bristles of small section are pressed together, the eyelashes cannot enter between these bristles which lie on top of one another during making up. On the other hand, the suppleness of these bristles gives the make-up a pleasant nature, preventing irritation of the skin. By virtue of this suppleness, it is moreover possible to apply the product in a uniform manner.

In order to improve the make-up result, it has been proposed to provide the brush with bristles of larger section which remain more heavily charged with the product after wiping, especially if they are provided with capillary grooves.

FR-A-2 637 472 describes a brush of this kind, in which bristles of large section are mixed with bristles of small section, the length of the latter being greater than that of the bristles of large section. The bristles of relatively large section make it possible to take up a sufficient quantity of the product for application to the eyelashes and for combing and smoothing the latter, while the longer bristles of small section provide for softness and separation of the brush provided with large bristles.

However, the make-up obtained with a brush of this kind is relatively natural and it is hardly possible to produce very different make-up effects as a certain uniformity is obtained as a result of the action of the supple bristles forming a down above the ends of the large bristles.

The object of the invention is above all to provide a brush for the application of a cosmetic product by means of which it is possible to obtain very different make-up effects.

SUMMARY OF THE INVENTION

In order to solve this problem, in accordance with the invention, a brush of the type defined hereinbefore is characterised in that in at least one zone of the brush the bristles of relatively large section are longer than the bristles of relatively small section and that at least the outer ends of the bristles of small section display a bulge.

The ends of the bristles of relatively large section preferably also display a bulge.

In this manner, according to the invention, the bristles of relatively large section are prominent and exert a more marked action on the make-up, while the bristles of small section continue to play a not insignificant role in the distribution of the product. The increase in the role of the bristles of large section does not lead to any particular irritation of the skin, in particular by virtue of the bulges provided at their outer ends.

The bristles of large section are generally longer over the entire extent of the brush than the bristles of small section, and display bulges at their ends.

However, this arrangement can only be provided over a fraction of the length of the brush or over an angular fraction of the transverse section. In the remaining part of the brush, the bristles of small section have a length equal to that of the bristles of large section.

The difference in transverse section between the bristles results in a difference in suppleness, this being greater for the bristles of small section.

The bristles may be formed of nylon or polyester fibres, the bristles of small section having a diameter of less than 10/100 of a millimeter (0.10 mm), while the large bristles have a diameter equal to or greater than 10/100 of a millimeter (0.10 mm) and generally less than 30/100 of a millimeter (0.30 mm).

The bristles, whether stiff or soft, are preferably of synthetic origin.

The cross-sectional shape of the bristles, in particular, large bristles, is preferably one of the following types: a solid circular shape, a hollow circular shape, a multilobar, in particular, trilobar shape, or a horseshoe shape.

The outer ends of the large bristles may be situated on a first surface having a different contour from a second surface on which the ends of the bristles of small section are situated, the first surface being situated outside the second surface.

The contours of the first and the second surfaces, in a section perpendicular to the core of the brush, may be formed by circles, which may be concentric or eccentric.

The invention also relates to a process for the manufacture of a brush of the type defined hereinbefore, this process being characterised by the following stages:

a model brush is produced with bristles of large transverse section and bristles of small section having the same length in a transverse section perpendicular to the axis of the brush, the large bristles being adapted to display greater heat resistance than the bristles of small section;

at least part of the brush is exposed to a source of heat sufficiently strong to result in melting and retraction of the ends of the bristles, the bristles of large transverse section undergoing less retraction than the bristles of small section, bulges owing to the melting of the material of the bristles being formed at the ends of the large bristles and/or the bristles of small section.

The brush is preferably disposed on means adapted to rotate it about its axis at high speed.

The source of heat is advantageously selected from among the following sources: hot air supply, infrared source, electrical resistor.

The brush may be selected from among brushes of the type having a metal core or even from the type which are completely injection-moulded. The model brush may comprise an eccentric core, but it is preferably concentric.

BRIEF DESCRIPTION OF THE DRAWINGS

In addition to the arrangements described hereinabove, the invention consists of a number of other arrangements described in more detail hereinafter by way of non-limiting embodiments described with reference to the accompanying drawings, in which.

DETAILED DESCRIPTION OF THE INVENTION

Figure 1:
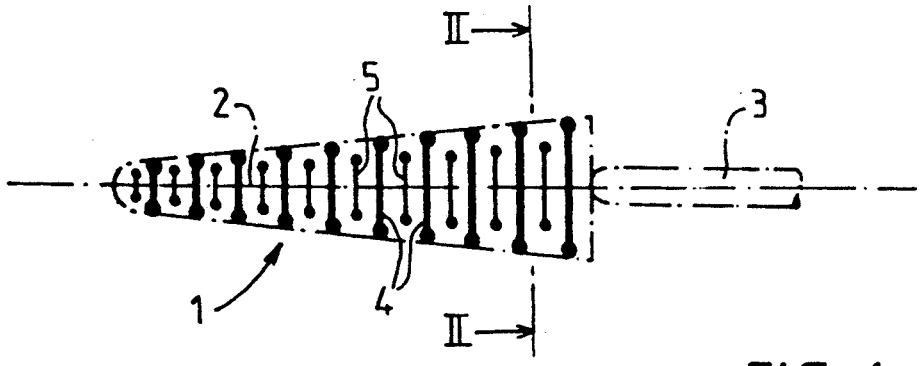
FIG. 1 is a diagrammatic side view of a brush according to the invention.
Figure 2:
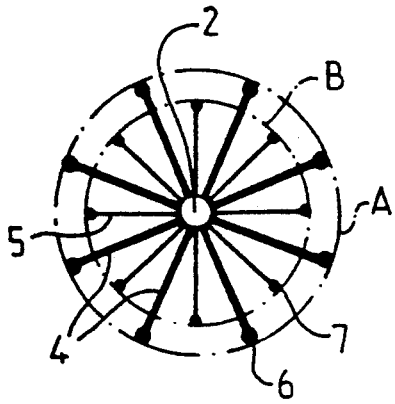
FIG. 2 is a view along the line II—II of FIG. 1 on a larger scale.

Referring to the drawings, more particularly to FIGS. 1 and 2, they show a brush 1 for the application of a cosmetic product, especially for the application of mascara to the eyelashes, comprising a plurality of bristles transversely implanted in a core 2 formed, in particular, by twisted metal spirals. This core is integral with a holder 3 for the brush. The bristles of the brush are formed by a statistical mixture of bristles of relatively large transverse section 4 and bristles of small section 5.

The term statistical mixture refers to a mixture in which the distribution of the bristles of large section and of small section is substantially regular for each type of bristle, in particular, in a transverse section, over one complete turn.

The bristles of relatively large section 4 are longer than the bristles of small section, so that in a transverse section of the brush, as shown in FIG. 2, the outer ends of the large bristles 4 project beyond the outer ends of the bristles of small section 5. The outer end of a bristle of relatively large section is provided with a bulge 6 of substantially spherical shape.

For the sake of clarity and simplification of the drawing, in FIG. 1, the bristles of small section 5 have been placed in the axial direction between the large bristles. However, it is clear that large bristles 4 and bristles of small section 5 can be found in one transverse section, i.e. at one level in the axial direction of the core 2.

The outer ends of the bristles of small section 5 also display a substantially spherical bulge 7.

The difference in transverse section between the bristles 4 and 5 results in a difference in suppleness. The suppleness is greater for the bristles of small section.

E.g. it is possible to use synthetic bristles, produced of the same material, formed of nylon or polyester fibres, the bristles of small section 5 having a diameter of less than 10/100 of a millimeter, while the large bristles 4 have a diameter equal to or greater than 10/100 of a millimeter and generally less than 30/100 of a millimeter.

It should be noted that the bristles of the brush 1, whether stiff or soft, are generally of synthetic origin, although the selection of the basic material may be different.

The cross section of the bristles 4, 5 may have variable shapes, and, in particular, may be one of the following types: solid circular shapes, hollow circular shapes, multilobar, in particular, trilobar shapes, or horseshoe shapes. This type of bristle is described, e.g. in FR-A-2 607 372 and in FR-A-2 607 373. Hollow bristles or bristles comprising capillary grooves are advantageous as they serve as a reservoir for the product to be taken up, in particular, mascara.

A brush is produced using a mixture of synthetic bristles of different diameters and cross-sectional shapes, e.g. 8/100 of a millimeter for the bristles of small solid circular section and 17/100 of a millimeter for the large bristles of cruciform cross section.

The brush 1 may have a contour of a predetermined shape along its length, e.g. a truncated contour as illustrated in FIG. 1. The dimensions of the large bristles 4 and the bristles of small section 5 gradually decrease from the holder 3 towards the tip of the brush, but, in one transverse section, the large bristles retain a length greater than that of the bristles of small section.

The outer ends of the bristles of large section 4 are situated on a first surface A having a different contour from a second surface B on which the ends of the bristles of small section 5 are situated. The first surface A surrounds the surface B. In the example in question, the contours of these two surfaces, in a section perpendicular to the axis of the core 2 of the brush, are formed by concentric circles. However, these circles could be eccentric.

Figure 4:
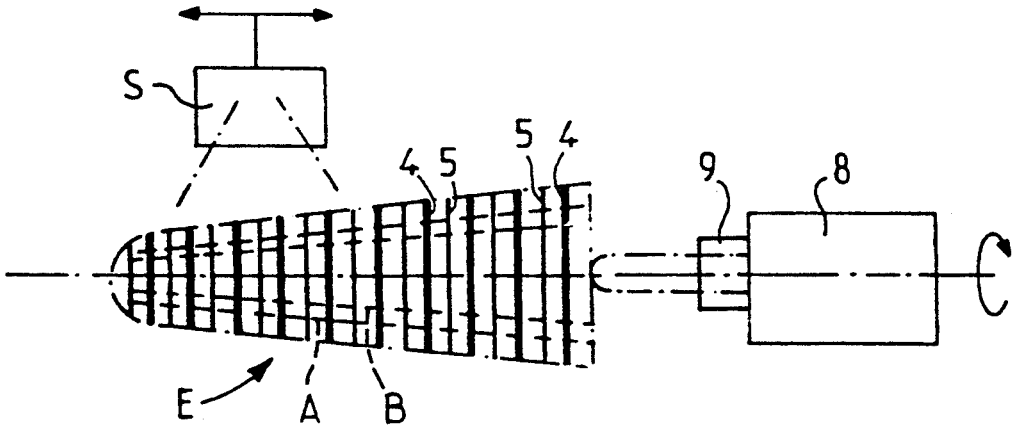
FIG. 4 is a diagram illustrating a process for the manufacture of a brush according to the invention.
Figure 5A:
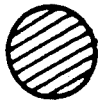
FIGS. 5*a*–5*d* illustrate various shapes for the bristles used in the method of the present invention.
Figure 5B:
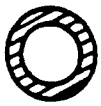
Figure 5C:
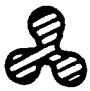
Figure 5D:
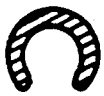

FIG. 4 shows an advantageous process for the manufacture of a brush according to the invention.

In a first stage, a model brush E is produced with bristles of large section 4 and bristles of small section 5 having the same length in a transverse section perpendicular to the axis of the brush. The shape of the general contour of this model in the direction of the length is similar to that desired for the finished brush. In the example in question, this profile is truncated, but is situated beyond the finished profiles A, B.

The large bristles 4 are adapted to display greater heat resistance than the bristles of small section 5. If these bristles are produced from the same material, the fact that the large bristles 4 have a greater transverse section is sufficient to give them greater heat resistance.

It is possible to vary the heat resistance by selecting, e.g. a mixture of bristles of different diameters formed of different materials having melting points at different temperatures.

The model brush is mounted on a lathe 8. e.g. by fixing the holder 3 into the chuck 9 of this lathe, and the brush is rotated about its axis at high speed.

This brush is exposed, parallel to its axis, and at a certain radial distance, to a source of heat S which may consist of a hot air supply, an infrared source, or an electrical resistor. Heating is controlled so that the ends of the bristles 4 and 5 undergo melting.

A bristle of small section 5 will melt more rapidly than a large bristle 4 and will retract more rapidly and over a greater distance than the large bristles 4.

At the end of the operation, it will be noted that the bristles of large section 4 are longer than the bristles of small section 5, as illustrated in FIG. 2. In addition, each bristle end displays the respective bulge 6, 7 forming a sort of "rounded nail head", giving the bristles of large section in particular a certain "sliding" action over the eyelash, and preventing any irritation in spite of the large diameter of these bristles.

The results obtained may be adjusted with respect to the heights and to the shapes of the bulges by using a mixture of bristles different, on the one hand, from the point of view of the diameters of the cross sections, and, on the other hand, from the point of view of the shapes of the cross sections.

It can be stated that with a given temperature control for the source S, at a given rotational speed of the brush about its axis and with the source S being at a given distance from the axis of the brush, many different brushes will be obtained according to the variation in the percentage of bristles of one type in relation to another, possibly with respect to a third type of bristle, both with respect to diameters, and with respect to sections, as the retraction of the bristles will still depend on the shape and on the diameter of each bristle and, if appropriate, on the material used for the bristles, a material the melting point of which can vary.

The brushes produced in this manner may comprise an infinite number of variants and may lead to very different make-up effects according to the types of bristles mixed and implanted, the percentage of each of the different bristles and the different materials.

Moreover, as a result of the prominence of the bristles of large transverse section 4, it is possible to obtain with one brush more heavily charged make-up which can be modified more easily as a function of the manner in which the user holds the brush.

Figure 3:
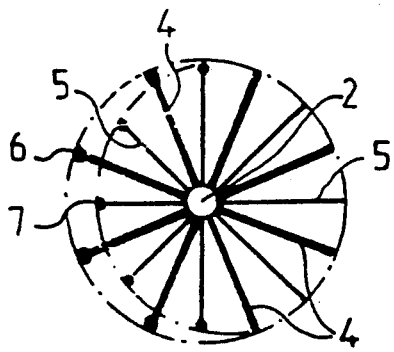
FIG. 3 is a view similar to that of FIG. 2 of a variant embodiment, in which only an angular sector of a transverse section has bristles of different lengths, while the remainder of the transverse section has bristles of the same length, the ends of which do not display bulges, and finally

It should be noted that the presence of large bristles longer than the bristles of small section and provided at their outer ends with bulges, can only be provided for over part of the length of the brush 1, or over a fraction of the transverse section, as illustrated in FIG. 3. The transverse half section situated on the left of FIG. 3 comprises large longer bristles provided at their outer ends with bulges and shorter bristles of small section also provided with bulges. On the other hand, the half section situated on the right has large bristles and bristles of small section of the same length, without bulges at their outer ends. A brush according to FIG. 3 can be obtained by subjecting the model described hereinbefore to the source of heat S without rotating this model about its axis.

I claim:

1. A process for the manufacture of a brush of the type having a plurality of bristles implanted on a twisted metal spiral core with at least some of the bristles being formed of a mixture of bristles of relatively large section and bristles of relatively small section and wherein at least one zone of the brush has bristles of relatively large section longer in length than the bristles of relatively small section and wherein the outer ends of the bristles display a bulge, the steps comprising:

first assembling a brush with said bristles of relatively large section together with bristles of relatively small section with the said bristles having the same length relative to the perpendicular axis of the brush, with the bristles of relatively large section being adapted to display greater heat-resistance than the bristles of relatively small section; and exposing at least part of the brush to a source of heat sufficiently strong to result in melting and shrinkage of the ends of the bristles, with the bristles of relatively large section undergoing less shrinkage than the bristles of relatively small section, said exposure to heat creating bulges due to the melting of the ends of the bristles of both said small section and large section.

2. The process as claimed in claim 1, further including the step of disposing the brush on rotating means to rotate the brush about its own axis at high speed.

3. The process as claimed in claim 1, including the step of selecting the source of heat from one of hot air supply, infra-red, electrical resistance.

4. A process according to claim 1, including the step of using bristles of large section which are longer over the entire extent of the brush than the bristles of small section.

5. A process according to claim 1, including the step of using bristles of large transverse section which are only longer than the bristles of small section over an angular fraction of the transverse section, the bristles of small section having a length equal to that of the bristles of large transverse section in the remaining part of the brush.

6. A process according to claim 1, including the step of using bristles of small section having a diameter of less than 10/100 of a millimeter, while the bristles of relatively large transverse section have a diameter equal to a greater than 10/100 of a millimeter and generally less than 30/100 of a millimeter.

7. A process according to claim 1, including the step of using bristles having a cross section of a solid circular shape.

8. Process according to claim 7, wherein said bristles are hollow.

9. A process according to claim 1, including the step of using bristles having outer ends of relatively large transverse section and which are situated on a first virtual surface having a different contour from a second virtual surface on which the ends of the bristles of small section are situated, the first virtual surface being situated outside the second virtual surface.

10. Process according to claim 1, wherein the cross-section of the bristles is multi-lobar.

11. Process according to claim 10, wherein the cross-section of the bristles is tri-lobar.

12. Process according to claim 1, wherein the cross-section of the bristles is horseshoe-shaped.

* * * * *